US005138121A

United States Patent [19]

Streich et al.

[11] Patent Number: 5,138,121

[45] Date of Patent: Aug. 11, 1992

[54] AUXILIARY CONTACT MOUNTING BLOCK

[75] Inventors: Georg Streich, Amberg; Guenter Gnahn, Sulzbach-Rosenberg, both of Fed. Rep. of Germany

[73] Assignee: Siemens Aktiengesellschaft, Berlin & Munich, Fed. Rep. of Germany

[21] Appl. No.: 567,798

[22] Filed: Aug. 15, 1990

[30] Foreign Application Priority Data

Aug. 16, 1989 [DE] Fed. Rep. of Germany ... 8909831[U]

[51] Int. Cl.[5] ..... H01H 9/08

[52] U.S. Cl. ..... 200/293; 200/295; 361/353

[58] Field of Search ..... 200/293, 295, 307, 296; 361/353

[56] References Cited

U.S. PATENT DOCUMENTS

| | | | |
|---|---|---|---|
| 3,621,173 | 11/1971 | O'Cheskey | 200/295 |
| 3,725,626 | 4/1973 | Kruse | 200/295 |
| 4,080,522 | 3/1978 | Schimmels | 200/295 |
| 4,181,924 | 1/1980 | Thomas et al. | 361/353 |
| 4,454,397 | 6/1984 | Kim | 200/296 |
| 4,587,391 | 5/1986 | Harper | 200/296 |
| 4,760,364 | 7/1988 | Ostby | 200/293 |

FOREIGN PATENT DOCUMENTS

| | | | |
|---|---|---|---|
| 0045683 | 2/1982 | European Pat. Off. . | |
| 0086698 | 8/1983 | European Pat. Off. | 200/295 |
| 6609020 | 2/1972 | Fed. Rep. of Germany . | |
| 2149365 | 4/1972 | Fed. Rep. of Germany . | |
| 6609531 | 7/1972 | Fed. Rep. of Germany . | |
| 2346210 | 5/1975 | Fed. Rep. of Germany | 200/295 |
| 7342273 | 6/1975 | Fed. Rep. of Germany . | |
| 2559398 | 9/1976 | Fed. Rep. of Germany | 200/295 |
| 2809754 | 10/1978 | Fed. Rep. of Germany . | |
| 2849421 | 9/1980 | Fed. Rep. of Germany . | |
| 3503292 | 8/1986 | Fed. Rep. of Germany . | |
| 493928 | 8/1970 | Switzerland . | |

*Primary Examiner*—Ernest G. Cusick
*Attorney, Agent, or Firm*—Kenyon & Kenyon

[57] ABSTRACT

An auxiliary contact mounting block for electromagnetic switching devices, having a housing comprising two shells, a hook, which is able to mate with a marginal ledge of the switching device while facing the switching device during mounting, and a ratchet, which latches with parts of the switching device in the mounted condition. The ratchet and the hook are premolded as whole pieces on respective ones of the two shells. A bezelled crossbar is premolded in front of the entry slot for the supply leads on the shell with the ratchet so that the entry slot is divided into two entry slots for the supply leads.

19 Claims, 2 Drawing Sheets

AUXILIARY CONTACT MOUNTING BLOCK

BACKGROUND OF THE INVENTION

The present invention relates to an auxiliary contact mounting block for electromagnetic switching devices, having a housing comprising two shells; a hook, which is able to mate with a marginal ledge of the switching device while facing the switching device during mounting; a ratchet, which latches with parts of the switching device in the mounted condition; and terminal screws for the stationary contacts with a gable-shaped clamping piece that permits the introduction of two supply leads.

In a known switching device of the above type (EP 0 045 683), a separate part, which is rotatably supported by a journal, is used for the ratchet. The hook in this case is premolded in halves on both shells.

SUMMARY OF THE INVENTION

It is an object of the invention to provide an auxiliary contact mounting block for an electromagnetic switching device having a housing comprising two shells which is simple and inexpensive to produce.

The objects of the invention are achieved in a simple manner in that the ratchet and the hook are premolded as whole pieces on respectively one of the two shells. In this manner, the further advantage results that only the one shell must be manufactured using cross slides, while the other shell is to be manufactured using a tool without cross slides.

The above and other objects of the invention are achieved by an auxiliary contact mounting block for electromagnetic switching devices, having a housing, comprising two shells; a hook, which is able to mate with a marginal ledge of the switching device while facing the switching device during mounting; a ratchet which latches with parts of the switching device in the mounted condition; and terminal means for the stationary contacts with a gable-shaped clamping piece that permits the introduction of two supply leads, wherein the ratchet and the hook are premolded as whole pieces on one of the two shells, respectively.

Since in any case cross slides are required for the one shell, it is further advantageous if a bezelled crossbar is premolded on this shell in front of the entry slot for the supply leads. In this manner, two supply leads are prevented from being introduced into the supply terminal on one side. In order to be able to substantially adjust the spring characteristic to the requirements, it is further advantageous if the ratchet is designed in a U shape between the premolded shape and notched edge.

If very strong shocks are to be reckoned with, then it can be of further advantage if a spring is inserted between the U-legs.

In order to prevent blocking the ratchet through the intrusion of foreign bodies while the auxiliary contact block is being removed, it is further advantageous if the open side of the U is covered by an actuating extension which is premolded on the one leg of the U. The fulcrum for the notched edge can be determined in a simple manner with regard to the spring if the one leg of the U is premolded on the one shell. An overloading of the premolded spring can be avoided if stop faces are provided in the one shell for the actuating extension in the resting and stressed conditions of the ratchet. The recognition as well as the operation of the actuating extension is facilitated when the actuating surface of the actuating extension is fluted over a large surface area.

In order to prevent the ends of the supply leads from being able to be inserted into the arcing chamber, it is advantageous if the passage for the stationary contact points is designed to overlap from the terminal housing into the arcing chamber.

SUMMARY OF THE DRAWINGS

The invention will be described in greater detail in the following detailed description with reference to the drawings, in which.

BRIEF DESCRIPTION OF THE DRAWINGS

Figure 1:
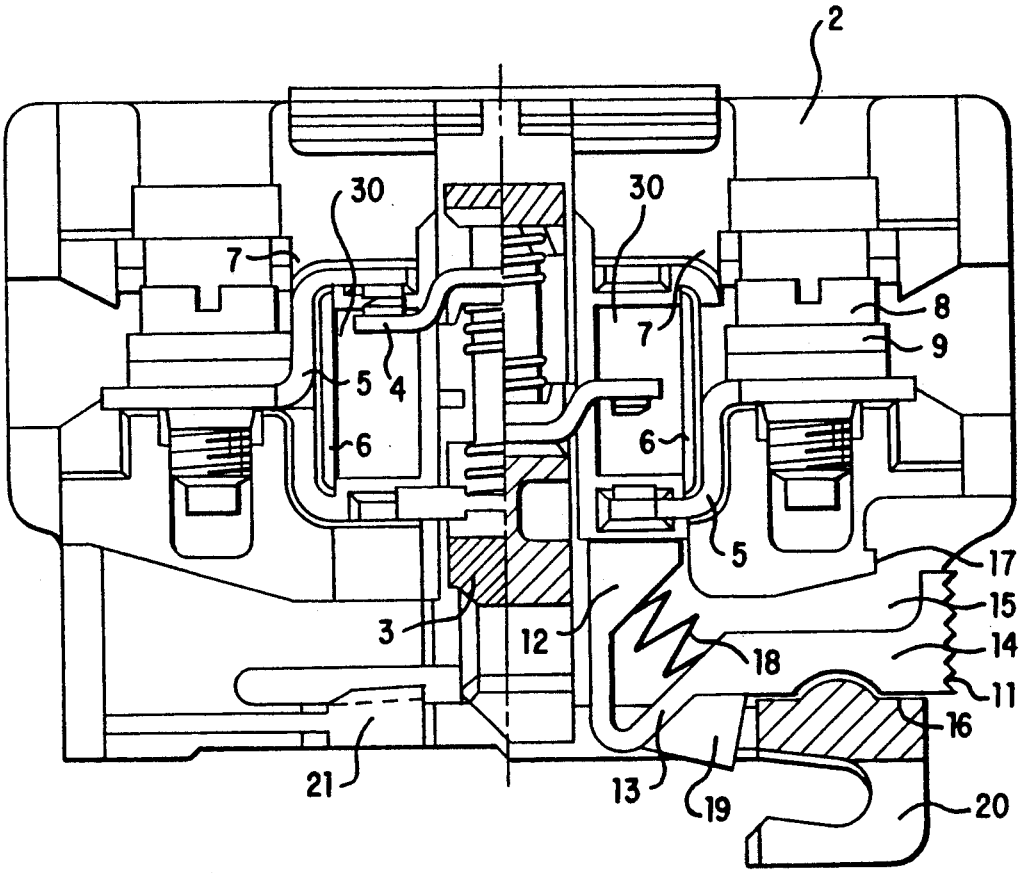
FIG. 1 shows a longitudinal section through the auxiliary contact mounting block.
Figure 2:
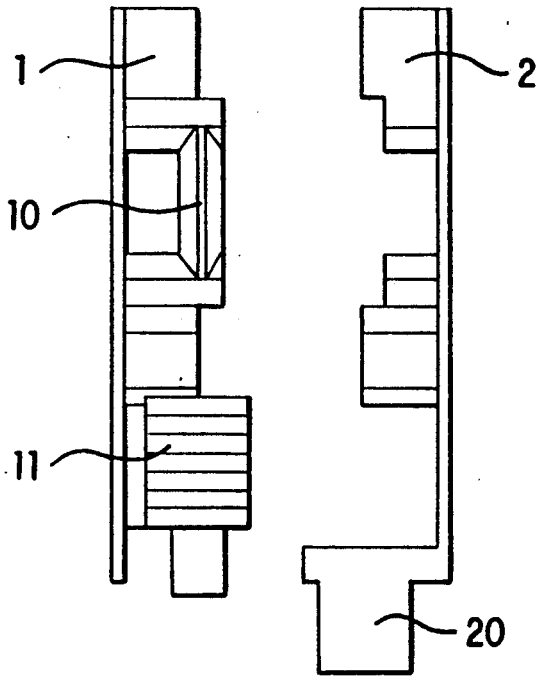
FIG. 2 shows a front view of the two housing shells separated from each other.
Figure 3:
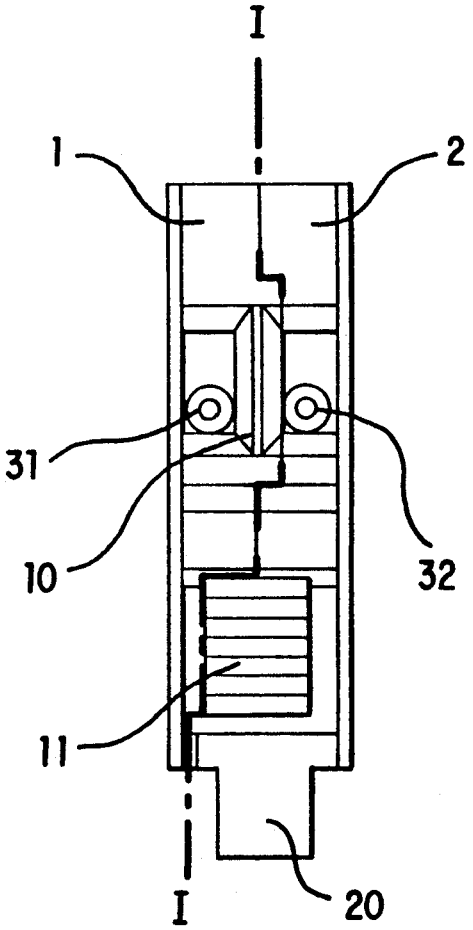
FIG. 3 shows a front view of the two housing shells attached with leads separated by a wall.

With reference now to the drawings, the contact bridge carrier 3 with the contact bridge 4 is held in a movable fashion, and the stationary contacts 5 are held in a form locking manner between the housing shells 1 and 2. In FIG. 1, the left stationary contact is shown together with the contact bridge as a break contact and the right stationary contact is shown together with the contact bridge as a make contact. The stationary contacts are bent in a staircase shape. The passage is formed by the walls 6 and 7 in an overlapping manner, i.e., in a labyrinth shape, so that no supply leads can be inserted into the arcing chamber. A chamber 30 is defined where the contacts 4 and 5 are positioned. Walls 6 and 7 prevent supply leads 31, 32 from being inserted into this chamber 30. Terminal screws 8 which are studded with gable-shaped clamping pieces 9 serve to connect the supply leads to the stationary contacts. As FIG. 2 shows, a bezelled crossbar 10, which shares the entry slot for the supply leads, is premolded onto the housing shell 1 so that one supply lead can be introduced to the left and to the right of the terminal screw, respectively. Furthermore, a ratchet 11, which is designed in a U shape as shown in FIG. 1, is premolded on the housing shell 1. The one leg 12 of the U is at least partially connected to the floor of the housing shell 1. The other leg 13 terminates in an actuating extension 14 which is shaped such that it shields the opening 15 so that no foreign bodies can intrude into the spring region of the ratchet and thus could interfere with the removal of the auxiliary contact block. The actuating extension 14 is fluted on the outside so that it is both more easily identified and operated as an actuator. Stops 16 and 17 serve to limit the positions of the actuating extension. If needed, a compression spring 18 can be inserted between the two legs 12,13 when the housing shells are separated. The notched edge of the ratchet is designated as 19. The hook 20 which is premolded on the housing shell 2 serves to anchor the auxiliary contact block onto the electromagnetic switching device. Crosspieces 21 are premolded on the side of the housing shells 1 and 2 opposite the hook 20, which can interact with projections on the housing of the electromagnetic switching device which are not shown more closely. In an equivalent manner, the contact bridge carrier 3 is also coupled to the contact bridge carrier of the electromagnetic switching device.

By means of the invention, an auxiliary contact mounting block has been provided whose housing can be manufactured with an integrated ratchet and anchoring hook in a simple manner. Only for manufacturing housing shell 1 is a tool with cross slides required. The housing shell 2 is able to be manufactured in a form without cross slides.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An auxiliary contact mounting block for hooking to a marginal ledge of an electromagnetic switching device and latching thereto, said auxiliary contact mounting block comprising:

a) a housing including a first shell and a second shell;

b) a hook for anchoring to the electromagnetic switching device, said hook being integrally molded with said second shell;

c) a ratchet for latching to the electromagnetic switching device, said ratchet being integrally molded with said first shell d) an entry slot formed in said housing for accepting a pair of supply leads; and e) a bevelled crossbar dividing said entry slot, said bevelled crossbar being integrally molded with said first shell.

2. The auxiliary contact mounting device according to claim 1, wherein the ratchet further comprises a connection to the first shell, a notched edge and a U-shaped portion coupling the connection to the notched edge.

3. The auxiliary contact mounting device according to claim 2, wherein the U-shaped portion further comprises a first leg attached to said connection and a second leg attached to said notched edge, and said auxiliary contact mounting device further comprises a spring disposed between the first and second legs.

4. The auxiliary contact mounting device according to claim 3, wherein the U-shaped portion has an open side, and said auxuilliary contact mounting device further comprises an actuating extension attached to the second leg and substantially covering the open side.

5. The auxiliary contact mounting device according to claim 4, wherein the first leg is integrally molded with the first shell.

6. The auxiliary contact mounting device according to claim 5, wherein the actuating extension has a first end attached to said second leg and a second, fluted end.

7. The auxiliary contact mounting device according to claim 4, wherein said ratchet is movable between a resting position and a stressed position, and the first shell further comprises a first stop face engaging the actuating extension when the ratchet is in said resting position and a second stop face engaging the actuating extension when the ratchet is in said stressed position.

8. The auxiliary contact mounting device according to claim 4, wherein the actuating extension has a first end attached to said second leg and a second, fluted end.

9. The auxiliary contact mounting device according to claim 3, wherein the first leg is integrally molded with the first shell.

10. The auxiliary contact mounting device according to claim 9, wherein the actuating extension has a first end attached to said second leg and a second, fluted end.

11. The auxiliary contact mounting device according to claim 1, wherein the ratchet further comprises a connection to the first shell, a notched edge and a U-shaped portion coupling the connection to the notched edge.

12. The auxiliary contact mounting device according to claim 11, wherein the U-shaped portion further comprises a first leg attached to said connection and a second leg attached to said notched edge, and said auxiliary contact mounting device further comprises a spring disposed between the first and second legs.

13. The auxiliary contact mounting device according to claim 12, wherein the U-shaped portion has an open side, and said auxiliary contact mounting device further comprises an actuating extension attached to the second leg and substantially covering the open side.

14. The auxiliary contact mounting device according to claim 13, wherein the first leg is integrally molded with the first shell.

15. The auxiliary contact mounting device according to claim 13, wherein said ratchet is movable between a resting position and a stressed position, and the first shell further comprises a first stop face engaging the actuating extension when the ratchet is in said resting position and a second stop face engaging the actuating extension when the ratchet is in said stressed position.

16. The auxiliary contact mounting device according to claim 13, wherein the actuating extension has a first end attached to said second leg and a second, fluted end.

17. The auxiliary contact mounting device according to claim 12, wherein the first leg is integrally molded with the first shell.

18. The auxiliary contact mounting device according to claim 17, wherein the actuating extension has a first end attached to said second leg and a second, fluted end.

19. The auxiliary contact mounting device according to claim 1, said first and second shells defining therebetween a chamber and a passage connecting said entry slot with said chamber, and further comprising a wall partially obstructing said passage to prevent entry of the pair of supply leads into said chamber.

* * * * *